US006609092B1

(12) United States Patent
Ghitza et al.

(10) Patent No.: US 6,609,092 B1
(45) Date of Patent: Aug. 19, 2003

(54) METHOD AND APPARATUS FOR ESTIMATING SUBJECTIVE AUDIO SIGNAL QUALITY FROM OBJECTIVE DISTORTION MEASURES

(75) Inventors: Oded Ghitza, Westfield, NJ (US); Doh-Suk Kim, Kyongki-do (JP); Peter Kroon, Green Brook, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/464,901

(22) Filed: Dec. 16, 1999

(51) Int. Cl.[7] ..... G10L 21/02
(52) U.S. Cl. ..... 704/226; 704/228; 455/424
(58) Field of Search ..... 704/226, 228, 704/200, 501, 201; 455/423, 424, 425

(56) References Cited

U.S. PATENT DOCUMENTS

| | | | | |
|---|---|---|---|---|
| 4,905,285 A | | 2/1990 | Allen et al. | |
| 5,621,854 A | * | 4/1997 | Hollier | 704/228 |
| 5,794,188 A | * | 8/1998 | Hollier | 704/228 |
| 5,987,320 A | * | 11/1999 | Bobick | 455/423 |
| 6,205,421 B1 | * | 3/2001 | Morii | 704/226 |

OTHER PUBLICATIONS

ITU–T Recommendation P.861, Objective Quality Measurement of Telephone–Band (300–3400 Hz) Speech Codecs, Geneva, 43 pages, Feb. 1998.

ITU–T Recommendation P.810, Modulated Noise Reference Unit (MNRU), 13 pages, Feb. 1996.

O. Ghitza, "Auditory Nerve Representation as a Basis for Speech Processing," Advances in Speech Signal Processing, S. Furui and M. M. Sondhi, eds., New York: Marcel Dekker, pp. 453–485, 1992.

D.S. Kim et al., "Auditory Processing of Speech Signals for Robust Speech Recognition in Real–World Noisy Environments," IEEE Trans. on Speech and Audio Processing, pp. 1–38, Mar. 1998.

O. Ghitza, "Auditory Models and Human Performance in Tasks Related to Speech Coding and Speech Recognition," IEEE Trans. on Speech and Audio Processing, vol. 2, No. 1, Part II, pp. 115–132, Jan. 1994.

* cited by examiner

*Primary Examiner*—Daniel Abebe
(74) *Attorney, Agent, or Firm*—Ryan, Mason & Lewis, LLP

(57) ABSTRACT

A mapping function is generated between subjective measures of audio signal quality, e.g., mean opinion score (MOS) or degradation MOS (DMOS) measures, and corresponding objective distortion measures, e.g., auditory speech quality measures (ASQMs) or perceptual speech quality measures (PSQMs), for known audio signals. The subjective measures and corresponding objective distortion measures are determined in accordance with modulated noise reference unit (MNRU) conditions or other suitable distortion conditions placed on the source speech, and a regression analysis is applied to the results to generate the mapping function. The mapping function may then be utilized, e.g., to evaluate speech quality of additional source speech from a particular speech coding system. In this case, the objective distortion measure is generated using the additional source speech, and the resulting objective measure is applied as an input to the mapping function to generate an estimate of the value of the subjective measure. Advantageously, the mapping function is database-independent, and can thus be used, e.g., to generate accurate estimates of subjective measures of speech quality for speech databases unrelated to those used in generating the mapping function.

23 Claims, 1 Drawing Sheet

| | $\rho$ | | RMSE | |
|---|---|---|---|---|
| | PSQM | ASQM | PSQM | ASQM |
| DB-I | 0.843 | 0.841 | 0.344 | 0.350 |
| DB-II | 0.915 | 0.864 | 0.263 | 0.339 |
| DB-III (CLN) | 0.969 | 0.968 | 0.424 | 0.469 |
| DB-III | 0.838 | 0.953 | 0.445 | 0.250 |
| DB-III | 0.787 | 0.986 | 0.789 | 0.278 |

METHOD AND APPARATUS FOR ESTIMATING SUBJECTIVE AUDIO SIGNAL QUALITY FROM OBJECTIVE DISTORTION MEASURES

FIELD OF THE INVENTION

The present invention relates generally to speech processing systems, and more particularly to techniques for determining speech quality in such systems.

BACKGROUND OF THE INVENTION

The most accurate known techniques for evaluating the performance of speech coding systems are subjective speech quality assessment tests such as the well-known mean opinion score (MOS) test. However, these subjective tests are generally costly and time-consuming, and also difficult to reproduce. It is therefore desirable to replace the subjective tests with an objective test for evaluating speech coding performance.

As a result, considerable effort has been devoted to attempting to find a suitable objective distortion measure that will correlate well with subjective MOS measurements. One such objective distortion measure is known as the perceptual speech-quality measure (PSQM), and is described in J. G. Beerends and J. A. Stemerdink, "A perceptual speech-quality measure based on psychoacoustic sound representation," J. Audio Eng. Soc., Vol. 42, pp. 115–123, March 1994, which is incorporated by reference herein. The PSQM measure has been adopted as the ITU-T standard recommendation P.861 for telephone band speech. See ITU-T Recommendation P.861, Objective Quality Measurement of Telephone-Band (300–3400 Hz) Speech Codecs, Geneva, 1996, which is incorporated by reference herein.

Nonetheless, a number of significant problems remain with PSQM and other conventional objective distortion measures. For example, it has not been determined whether or how such measures can be mapped onto the subjective MOS scale in a database independent manner. In addition, conventional objective measures are in some cases unable to accurately assess the quality of processed speech when the source has been corrupted by environmental noise.

A need therefore exists for improved techniques for predicting the quality of speech and other audio signals, such that a subjective MOS measure or other type of subjective quality measure can be determined accurately and efficiently from a corresponding objective distortion measure, in a manner that is robust in the presence of environmental noise.

SUMMARY OF THE INVENTION

The invention provides methods and apparatus for estimating subjective measures of audio signal quality using objective distortion measures. In accordance with the invention, a mapping function is generated between subjective measures of audio signal quality, e.g., mean opinion score (MOS) measures, degradation MOS (DMOS) measures or other measures, and corresponding objective distortion measures, e.g., auditory speech quality measures (ASQMs), perceptual speech quality measures (PSQMs) or other objective distortion measures, for known audio signals. The audio signals may be speech signals or any other type of audio signals.

The subjective measures and corresponding objective distortion measures are determined in accordance with, e.g., modulated noise reference unit (MNRU) conditions or other suitable distortion conditions placed on the audio signals, and a regression analysis is applied to the results to generate the mapping function. The mapping function may then be utilized, e.g., to evaluate speech quality of additional source speech from a particular speech coding system. In this case, the objective distortion measure is generated using the additional source speech, and the resulting objective measure is applied as an input to the mapping function to generate an estimate of the value of the subjective measure.

Advantageously, the invention allows an objective distortion measure to be mapped in a database-independent manner to a subjective measure, e.g., a MOS or DMOS scale. The mapping function is database independent in that it can be used to generate accurate estimates of subjective measures of speech quality for speech databases unrelated to those used in generating the mapping function. In addition, the objective distortion to subjective quality measure mapping in an illustrative embodiment of the invention provides more accurate prediction than conventional techniques in the presence of environmental noise. The invention may be implemented in numerous and diverse speech and audio signal processing applications, and considerably improves the accuracy of quality prediction in such applications. These and other features and advantages of the present invention will become more apparent from the accompanying drawings and the following detailed description.

DETAILED DESCRIPTION OF THE INVENTION

Figures 1, 2:
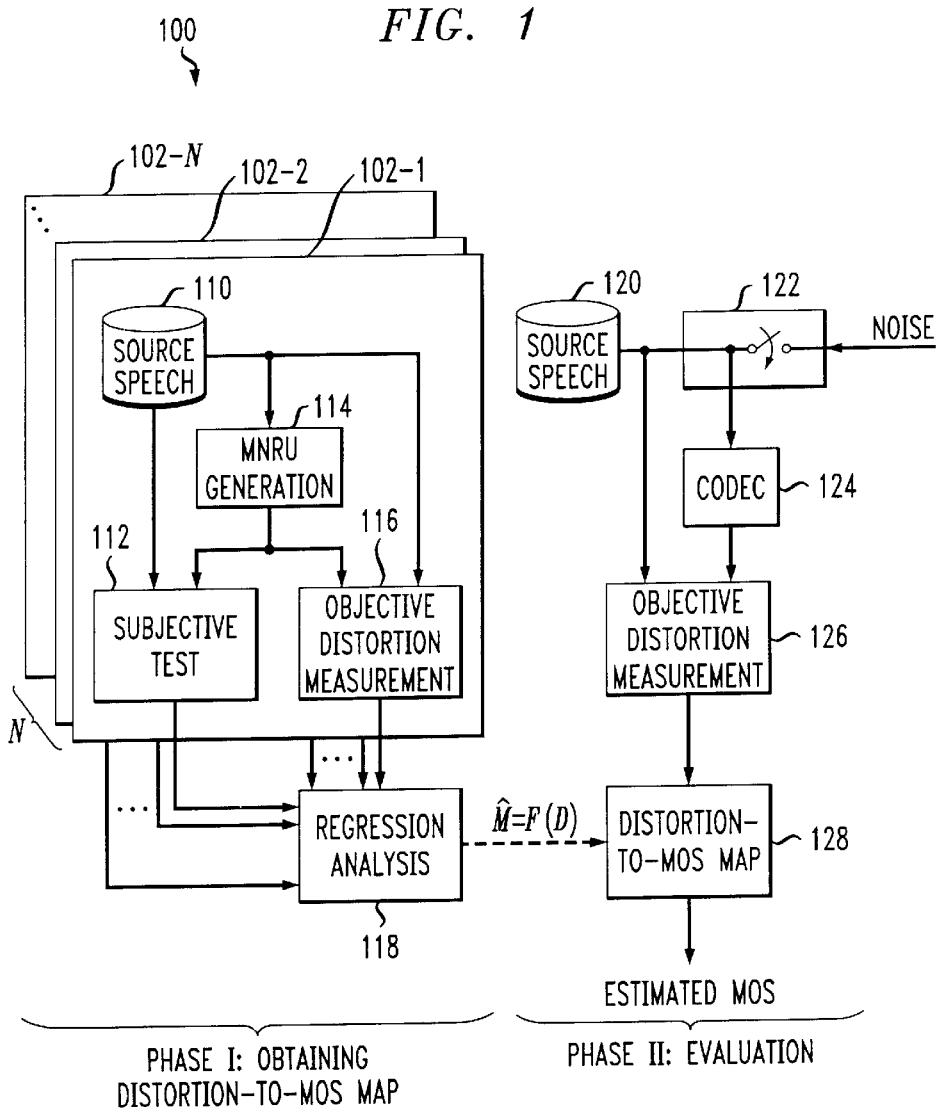
FIG. 1 shows an illustrative embodiment of the invention which implements a database-independent process for predicting a mean opinion score (MOS) of speech quality from an objective distortion measure in accordance with the invention.
FIG. 2 is a tabular listing of example evaluation results obtained using the speech quality prediction process illustrated in FIG. 1.

The present invention will be illustrated below in conjunction with an exemplary speech processing system. It should be understood, however, that the disclosed techniques are suitable for use with a wide variety of other systems and in numerous alternative applications, e.g., systems and applications involving the processing of other types of audio signals.

FIG. 1 shows a block diagram of a speech processing system 100 in an illustrative embodiment of the invention. The system 100 implements a database-independent mean opinion score (MOS) speech quality prediction process in two phases, denoted Phase I and Phase II. Phase I is a training phase which obtains a distortion-to-MOS map using N sets of operations 102-1, 102-2, . . . 102-N each based on a corresponding source speech database 110, and Phase II is an evaluation phase that utilizes the map obtained in Phase I to generate estimated MOS values for one or more sets of additional source speech utilized in a particular speech coding process.

Phase I of the system 100 for a given database 110 of source speech includes a subjective test operation 112, amodulated noise reference unit (MNRU) generation operation 114 and an objective distortion measurement operation 116. These operations are repeated for each of the N sets 102-1, 102-2, . . . 102-N, and the results of the subjective test and objective distortion measurement operations 112 and 116 are applied as inputs to a regression analysis operation 118. The output of the regression analysis operation 118 is a distortion-to-MOS mapping function, also referred to herein as a distortion-to-MOS map, of the form $$\hat{M}=F(D),$$

where $\hat{M}$ denotes an estimated MOS value, and D is an objective distortion measurement.

The use of subjective MOS measures and MNRU condition generation in the system 100 is by way of example only, and should not be construed as limiting the invention in any way. For example, the invention can be used with other types of subjective measures, such as degradation MOS (DMOS) measures, in which listeners rate the degradation from a first unprocessed sample to a second processed sample on a five-point scale. The MOS and DMOS measures are examples of more general categories of subjective measures commonly known as absolute category rating (ACR) and degradation category rating (DCR) measures, respectively. The present invention is suitable for use with these and other types of subjective measures.

In addition, alternative distortion conditions other than MNRU conditions can be used. These alternative conditions include, e.g., standard coders for specific bit rates. Numerous other subjective measures and distortion conditions suitable for use with the present invention will be readily apparent to those of ordinary skill in the art.

Phase II of the system 100 evaluates the speech quality performance of a particular speech coding system, using the distortion-to-MOS map obtained in Phase I. Source speech from a database 120 is supplied to an input of a switch 122 and to an input of an objective distortion measurement operation 126. When the switch 122 is in the open position as shown, the source speech passes directly through the switch 122 to an input of a codec 124 of the speech coding system to be evaluated. When the switch 122 is in the closed position, the source speech is combined with a noise signal and the resulting noisy source speech signal is applied to an input of the codec 124. The noise signal may be interfering noise of any kind.

The codec 124 encodes and then decodes the original or noisy source speech signal. The original source speech and the encoded/decoded version thereof from the codec 124 are both applied to the objective distortion measurement operation 126. The resulting objective distortion measurement is applied to a mapping operation 128 in which the above-noted distortion-to-MOS mapping function is used to convert the objective distortion measurement generated in operation 126 to a corresponding MOS value. Phase II of the system 100 is thus used to generate subjective MOS values characterizing the performance of the codec 124 based on objective distortion measures.

The illustrative configuration of system 100 is based at least in part on an assumption that subjective MOS scores of MNRU-conditioned speech sequences are consistent across different speech databases. The MNRU implemented in operation 114 of each of the N sets of operations 102-1, 102-2, . . . 102-N is described in greater detail in ITU-T Recommendation P.810, Modulated Noise Reference Unit (MNRU), February 1996, which is incorporated by reference herein.

It should again be emphasized that the use of MNRU conditions in the illustrative embodiment of FIG. 1 is by way of example only. The invention may be used in conjunction with many other types of distortion conditions generated using many other types of known techniques, such as the above-noted standard coders.

The operations 114 generate MNRU conditions for the source speech from the corresponding databases 110 for each of the sets 102-1, 102-2, . . . 102-N. Subjective MOS measures and objective distortion measures are then generated in operations 112 and 116, respectively, for the MNRU-conditioned source speech sequences from the set of N source speech databases. Operation 118 performs the regression analysis on the resulting MOS and distortion measures for the MNRU-conditioned sequences, as a function of signal-to-noise ratio (SNR), in order to provide the desired distortion-to-MOS mapping function.

Advantageously, the distortion-to-MOS mapping function generated in Phase I of the system 100 is independent of the source speech material from the database 120 and the nature of the evaluated codec 124. As a result, the distortion-to-MOS mapping function can be used with a variety of different types of source speech material and codecs. Note that the objective distortion measurement of the processed speech from codec 124 in operation 126 is with respect to the "clean" source speech, i.e., the original source speech without the introduction of noise. This will also generally be the case when the processed speech applied to operation 126 is a noisy, unprocessed, speech source.

The objective distortion measurement in operations 116 and 126 of FIG. 1 will now be described in greater detail. The objective distortion measure used in this illustrative embodiment is a psychophysically-inspired objective distortion measure, referred to herein as an auditory speech quality measure (ASQM). The ASQM in accordance with the invention measures the distortion of a processed version of a source speech using a peripheral model of the mammalian auditory system. Advantageously, the robustness of auditory-based speech quality measures to environmental noise results in an objective distortion measurement that correlates well with subjective quality assessments of speech.

It should be noted that, although the mapping techniques of the invention can be used with (i) auditory-based measures such as ASQM that are based on peripheral properties of the auditory system, (ii) perceptual distortion measures such as PSQM that are based on cognitive properties of the auditory system, and (iii) other types of objective distortion measures, the illustrative embodiment will be described in conjunction with ASQM. This is by way of example only, and should not be construed as limiting the scope of the invention in any way.

A given objective distortion measurement operation for generating the ASQM receives as inputs source speech x(n) and processed speech y(n). First, the overall active speech level of the source speech x(n) and the processed speech y(n) is normalized to −26 dBov using a speech level meter from the ITU software library, as described in ITU-T STL96, ITU-T Software Tool Library, Geneva, May 1996, which is incorporated by reference herein. Next, the time waveforms of the source and the processed speech are aligned. The level-adjusted and time-aligned signal is then transformed into a sequence of feature vectors using the above-noted auditory model. The a illustrative embodiment uses a zero-crossings with peak amplitude (ZCPA) model described in D.S. Kim, S. Y. Lee, and R. M. Kil, "Auditory processing of speech signals for robust speech recognition in real-world noisy environments," IEEE Trans. Speech and Audio Processing, Vol. 7, No. 1, pp. 55–69, 1999, which is incorporated by reference herein. It should be understood, of course, that this specific model is only an example, and many other types of models may be used. Finally, the two vector sequences are compared to produce an objective distortion value which is indicative of speech quality.

Let X(m, i) and Y(m, i) be the auditory representations of source and processed speech, respectively, at the mth frame. The index i, $1 \leqq i \leqq N_b$, denotes the frequency bin index, where $N_b$ is the dimension of the frame vector. The distortion at the mth frame is expressed as $$D(m) = \sum_{i=1}^{N_b} C(m, i)|X(m, i) - Y(m, i)| \tag{1}$$

where C(m, i) is an asymmetric weighting factor to account for the psychoacoustic observation, first introduced in the PSQM described in the above-cited J. G. Beerends and J. A. Stemerdink reference, that additive distortions in the time-frequency domain are subjectively more noticeable than equal amounts of subtractive distortion. The weighting factor C(m, i) is defined as $$C(m, i) = \left(\frac{Y(m, i) + \epsilon}{X(m, i) + \epsilon}\right)^a, \tag{2}$$

where $\epsilon$ is a small number to prevent division by zero and a is a control parameter greater than zero. Although the basic form of the asymmetric weighting factor is adopted from the PSQM, the parameters should be optimized for the auditory representations.

The overall distortion between the two sequences X and Y is determined by $$D = \gamma D_{sp} + (1-\gamma) D_{nsp} \tag{3}$$

where $\gamma$ is a weighting factor for active speech frames, and $D_{sp}$ and $D_{nsp}$ are the distortions for the speech portion and the non-speech portions of the signal, respectively. Distortions for the speech portion $D_{sp}$ and the non-speech portion $D_{nsp}$ are defined as $$D_{sp} = \frac{1}{\max_m L_Y(m) \cdot T_{sp}} \sum_{m, L_X(m) > K} D(m) \tag{4}$$

$$D_{nsp} = \frac{1}{\max_m L_Y(m) \cdot T_{nsp}} \sum_{m, L_X(m) \leq K} D(m) \tag{5}$$

where $L_x$ (m) and $L_y$ (m) are the pseudo-loudness of the source speech and the processed speech at the mth frame, respectively, K is the threshold for speech/non-speech decision, and $T_{sp}$ and $T_{nsp}$ are the number of active speech frames and the number of non-speech frames, respectively. For clean speech, only the active speech frames contribute to the overall distortion measure unless the speech coding system being evaluated generates high-power distortions in the non-speech frames.

Additional details regarding other auditory-based distortion measures suitable for use in conjunction with the invention can be found in, e.g., U.S. Pat. No. 4,905,285 issued Feb. 27, 1990 in the name of inventors J. B. Allen and O. Ghitza and entitled "Analysis arrangement based on a model of hunan neural responses;" O. Ghitza, "Auditory nerve representation as a basis for speech processing," Advances in Speech Signal Processing, S. Furui and M. M. Sondhi, eds., pp. 453–485, New York: Marcel Dekker, 1992; and D. S. Kim, S. Y. Lee, and R. M. Kil, "Auditory processing of speech signals for robust speech recognition in real-world noisy environments," IEEE Trans. Speech and Audio Processing, Vol. 7, No. 1, pp. 55–69, 1999; all of which are incorporated by reference herein.

An evaluation of the speech processing system of FIG. 1 was performed using three example databases, referred to herein as DB-I, DB-II and DB-III. It should noted that the term "database" as used in this evaluation refers both the speech material and the speech coding systems under evaluation. Databases DB-I and DB-II contained only clean speech material, comprised of thirty-two speech sentences, spoken by four male and four female speakers, and eleven different coders, ranging in bit-rate from 8 kb/s to 32 kb/s. Speech sentences were sampled at 8 kHz with 16 bit precision. The same eleven coders were used in both DB-I and DB-II. Database DB-I also contained eleven tandem conditions, where each condition is realized by operating two coders of the same type in tandem. In database DB-I, the source material was passed through a flat filter, and in database DB-II the source material was passed through the Intermediate Reference System (IRS) filter of the above-noted ITU software library. Two different MNRU conditions, 25 dB and 15 dB SNR conditions, were also included in each database.

Database DB-III contained clean speech as well as noisy speech material, comprised of twelve phonetically balanced sentences spoken by three male and three female speakers, and four different coders, i.e., an ITU-T G.726 coder operating at 32 kb/s, a G.729A coder operating at 8 kb/s, a G.723 coder operating at 6.3 kb/s, and a nonstandard 9.6 kb/s coder. Speech sentences were sampled at 8 kHz with 16 bit precision, and were IRS filtered. Two kinds of background noise were used, car noise and speech babble noise, both at 30 dB SNR with an average segmental SNR of 17 dB.° Four MNRU conditions were generated from clean speech, at 25, 20, 15 and 10 dB SNR.

FIG. 2 shows a table summarizing the performance of the system of FIG. 1 using a conventional PSQM and the above-described ASQM, for all three of the above-described databases. The table compares the performance of the PSQM-based and ASQM-based systems configured in accordance with the invention, in terms of correlation coefficient ρ and root-mean-squared error (RMSE) with respect to a distortion-to-MOS regression.

As previously noted, the mapping techniques of the invention can be used with ASQM, PSQM or other types of objective distortion measures. Although the table shown in FIG. 2 illustrates that the performance of the invention may be better when using ASQM than when using PSQM, the invention nonetheless could use either of these objective distortion measures or other suitable measures.

The first column of the table of FIG. 2 shows the correlation coefficient p between the objective distortion measure, i.e., PSQM or ASQM, and its corresponding subjective MOS values. The correlation coefficient p ranges from a value of zero, representing no correlation, to a value of one. The second column shows the RMSE with respect to the distortion-to-MOS mapping function of the invention. The RMSE is defined as:

$$RMSE = \frac{1}{M}\sqrt{\sum_{c=1}^{M} [S_c - F(D_c)]^2} \tag{6}$$

where $S_c$ is the mean subjective MOS of the cth coder, averaged over all speech sentences; $D_c$ is the mean, scaled, objective distortion of the cth coder, averaged over all speech sentences; F is the distortion-to-MOS mapping function; and M is the number of codecs. It should be noted that RMSE is a particularly relevant criterion in the case of evaluating computational models for MOS prediction, in that it provides the mean deviation of the predicted MOS value from the desired subjective MOS value.

It can be seen from the table of FIG. 2 that the PSQM-based and ASQM-based systems provide comparable performance for clean speech. However, ASQM outperforms PSQM in noisy conditions. In particular, the RMSE of ASQM is significantly smaller than that of PSQM for noisy speech, 44% less for car noise and 65% less for babble noise, which demonstrates the robustness of the periheral auditory model to environmental noise.

The results summarized in FIG. 2 indicate that the speech processing system of FIG. 1 provides MOS estimates that are highly correlated with actual subjective MOS scores obtained by real listening tests. The results confirm that a distortion-to-MOS mapping function based upon MNRU anchor points in accordance with the invention can be used to map distortion measurements of coded speech. It should be noted that alternative anchor points could also be used, such as standardized coders.

The processing operations of the FIG. 1 system, e.g., operations 112, 114, 116, 118, 122, 126 and 128, can be implemented in whole or in part using a general-purpose computer, such as a personal computer, workstation, microcomputer, etc. Alternatively, these processing operations can be implemented using special-purpose hardware, such as a suitably programmed microprocessor, microcontroller, application-specific integrated circuit (ASIC), or other data processing device. The operations could also be implemented using various combinations of these and other general-purpose and special-purpose processors. The FIG. 1 system may thus be embodied at least in part in, e.g., one or more software programs which are stored in an appropriate electronic, magnetic or optical memory device and downloaded for execution into a processor.

The above-described embodiments of the invention are intended to be illustrative only. For example, alternative embodiments of the invention can use audio signals other than speech, subjective distortion measures other than MOS or DMOS, objective distortion measures other than ASQM and PSQM, and distortion conditions other than MNRU conditions. These and numerous alternative embodiments may be devised by those skilled in the art without departing from the scope of the following claims.

What is claimed is:

1. A method of estimating audio signal quality, the method comprising the steps of:

generating a mapping function between a plurality of actual subjective measures determined for a given set of audio signals and corresponding objective distortion measures determined for the given set of audio signals; and utilizing the mapping function to generate an estimated subjective measure from an objective distortion measure determined for another audio signal;

wherein a portion of at least one of the objective distortion measures associated with an mth frame of a given source speech sequence is given by $$D(m) = \sum_{i=1}^{N_b} C(m, i)|X(m, i) - Y(m, i)|$$

where X(m, i) and Y(m, i) are auditory representations of source and processed speech, respectively, for the sequence, $1 \leqq i \leqq N_b$ denotes a frequency bin index, $N_b$ is the dimension of a frame vector, and C(m, i) is an asymmetric weighting factor;

wherein an overall auditory-based objective distortion measure between the source and processed speech sequences X and Y is determined by $$D = \gamma D_{sp}^{1} + (1-\gamma) D_{nsp}$$

where γ is a weighting factor for active speech frames, and $D_{sp}$ and $D_{nsp}$ are distortions for speech and non-speech portions of the sequences, respectively; and wherein the distortions for the speech portion $D_{sp}$ and the non-speech portion $D_{nsp}$ are defined as $$D_{sp} = \frac{1}{\max_m L_Y(m) \cdot T_{sp}} \sum_{m, L_X(m) > K} D(m)$$

$$D_{nsp} = \frac{1}{\max_m L_Y(m) \cdot T_{nsp}} \sum_{m, L_X(m) \leq K} D(m)$$

where $L_x$ (m) and $L_y$ (m) are pseudo-loudness of the source speech and the processed speech at the mth frame, respectively, K is a threshold for speech/non-speech decision, and $T_{sp}$ and $T_{nsp}$ are the number of active speech frames and the number of non-speech frames, respectively.

2. The method of claim 1 wherein the mapping function is generated by performing a regression analysis on the plurality of subjective measures and corresponding auditory-based objective distortion measures generated for each of N different source databases; and wherein the other audio signal for which the subjective measure is estimated is associated with a database that is independent of the N different source databases used in generating the mapping function.

3. The method of claim 1 wherein at least a subset of the audio signals comprise speech signals.

4. The method of claim 1 wherein at least a subset of the plurality of subjective measures and the estimated subjective measure comprise at least one of a mean opinion score (MOS) and a degradation MOS (DMOS).

5. The method of claim 1 wherein a given one of the objective distortion measures is generated by measuring a difference between an unprocessed audio signal and a corresponding processed audio signal.

6. The method of claim 1 wherein at least a subset of the objective distortion measures comprise auditory-based distortion measures based on one or more peripheral properties of an auditory system.

7. The method of claim 6 wherein at least a subset of the auditory-based objective distortion measures comprise an auditory speech quality measure (ASQM).

8. The method of claim 1 wherein at least a subset of the objective distortion measures comprise perceptual distortion measures based on one or more cognitive properties of an auditory system.

9. The method of claim 8 wherein at least a subset of the perceptual distortion measures comprise a perceptual speech quality measure (PSQM).

10. The method of claim 1 wherein the plurality of subjective measures and the corresponding objective distortion measures are determined in accordance with designated distortion conditions applied to the given set of audio signals.

11. The method of claim 10 wherein the designated distortion conditions comprise modulated noise reference unit (MNRU) conditions.

12. An apparatus comprising a processing system operative to generate a mapping function between a plurality of actual subjective measures determined for a given set of audio signals and corresponding objective distortion measures determined for the given set of audio signals, and to utilize the mapping function to generate an estimated subjective measure from an objective distortion measure determined for another audio signal;

wherein a portion of at least one of the objective distortion measures associated with an mth frame of a given source speech sequence is given by $$D(m) = \sum_{i=1}^{N_b} C(m, i)|X(m, i) - Y(m, i)|$$

where X(m, i) and Y(m, i) are auditory representations of source and processed speech, respectively, for the sequence, $1 \leqq i \leqq N_b$ denotes a frequency bin index, $N_b$ is the dimension of a frame vector, and C(m, i) is an asymmetric weighting factor;

wherein an overall auditory-based objective distortion measure between the source and processed speech sequences X and Y is determined by $$D=\gamma D_{sp}+(1-\gamma)D_{nsp}$$

where γ is a weighting factor for active speech frames, and $D_{sp}$ and $D_{nsp}$ are distortions for speech and non-speech portions of the sequences, respectively; and wherein the distortions for the speech portion $D_{sp}$ and the non-speech portion $D_{nsp}$ are defined as $$D_{sp} = \frac{1}{\max_m L_Y(m) \cdot T_{sp}} \sum_{m, L_X(m) > K} D(m)$$

$$D_{nsp} = \frac{1}{\max_m L_Y(m) \cdot T_{nsp}} \sum_{m, L_X(m) \leq K} D(m)$$

where $L_x$ (m) and $L_y$ (m) are pseudo-loudness of the source speech and the processed speech at the mth frame, respectively, K is a threshold for speech/non-speech decision, and $T_{sp}$ and $T_{nsp}$ are the number of active speech frames and the number of non-speech frames, respectively.

13. The apparatus of claim 12 wherein the processing system comprises a processor and an associated memory;

wherein the mapping function is generated by performing a regression analysis on the plurality of subjective measures and corresponding auditory-based objective distortion measures generated for each of N different source databases; and wherein the other audio signal for which the subjective measure is estimated is associated with a database that is independent of the N different source databases used in generating the mapping function.

14. The apparatus of claim 12 wherein at least a subset of the audio signals comprise speech signals.

15. The apparatus of claim 12 wherein at least a subset of the plurality of subjective measures and the estimated subjective measure comprise at least one of a mean opinion score (MOS) and a degradation MOS (DMOS).

16. The apparatus of claim 12 wherein a given one of the objective distortion measures is generated by measuring a difference between an unprocessed audio signal and a corresponding processed audio signal.

17. The apparatus of claim 12 wherein at least a subset of the objective distortion measures comprise auditory-based distortion measures based on one or more peripheral properties of an auditory system.

18. The apparatus of claim 17 wherein at least a subset of the auditory-based objective distortion measures comprise an auditory speech quality measure (ASQM).

19. The apparatus of claim 12 wherein at least a subset of the objective distortion measures comprise perceptual distortion measures based on one or more cognitive properties of an auditory system.

20. The apparatus of claim 19 wherein at least a subset of the perceptual distortion measures comprise a perceptual speech quality measure (PSQM).

21. The apparatus of claim 12 wherein the plurality of subjective measures and the corresponding objective distortion measures are determined in accordance with designated distortion conditions applied to the given set of audio signals.

22. The apparatus of claim 21 wherein the designated distortion conditions comprise modulated noise reference unit (MNRU) conditions.

23. An article of manufacture comprising a machine-readable medium for storing one or more software programs which when executed in a data processor implement the steps of:

generating a mapping function between a plurality of actual subjective measures determined for a given set of audio signals and corresponding objective distortion measures determined for the given set of audio signals; and utilizing the mapping function to generate an estimated subjective measure from an objective distortion measure determined for another audio signal;

wherein a portion of at least one of the objective distortion measures associated with an mth frame of a given source speech sequence is given by $$D(m) = \sum_{i=1}^{N_b} C(m, i)|X(m, i) - Y(m, i)|$$

where X(m, i) and Y(m, i) are auditory representations of source and processed speech, respectively, for the sequence, $1 \leqq i \leqq N_b$ denotes a frequency bin index, $N_b$ is the dimension of a frame vector, and C(m, i) is an asymmetric weighting factor;

wherein an overall auditory-based objective distortion measure between the source and processed speech sequences X and Y is determined by $$D=\gamma D_{sp}+(1-\gamma)D_{nsp}$$

where γ is a weighting factor for active speech frames, and $D_{sp}$ and $D_{nsp}$ are distortions for speech and non-speech portions of the sequences, respectively; and wherein the distortions for the speech portion $D_{sp}$ and the non-speech portion $D_{nsp}$ are defined as $$D_{sp} = \frac{1}{\max_m L_Y(m) \cdot T_{sp}} \sum_{m, L_X(m) > K} D(m)$$

$$D_{nsp} = \frac{1}{\max_m L_Y(m) \cdot T_{nsp}} \sum_{m, L_X(m) \leq K} D(m)$$

where $L_X$ (m) and $L_y$ (m) are pseudo-loudness of the source speech and the processed speech at the mth frame, respectively, K is a threshold for speech/non-speech decision, and $T_{sp}$ and $T_{nsp}$ are the number of active speech frames and the number of non-speech frames, respectively.

* * * * *